US006506986B2

(12) United States Patent
Bernier et al.

(10) Patent No.: US 6,506,986 B2
(45) Date of Patent: Jan. 14, 2003

(54) ALTERNATE DOOR INTERLOCK DEFEATER

(75) Inventors: Richard Emery Bernier, Mebane, NC (US); Gilbert Anthony Soares, Mebane, NC (US); Charles Piper, Burlington, NC (US); Edgar Yee, Chapel Hill, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,435

(22) Filed: Dec. 28, 2001

(65) Prior Publication Data

US 2002/0112944 A1 Aug. 22, 2002

Related U.S. Application Data

(63) Continuation of application No. 09/474,512, filed on Dec. 29, 1999, now abandoned.

(51) Int. Cl.[7] ..... H01R 13/70
(52) U.S. Cl. ..... 200/50.01; 200/50.13
(58) Field of Search ..... 200/50.01, 50.13, 200/50.15

(56) References Cited

U.S. PATENT DOCUMENTS

| | | | |
|---|---|---|---|
| 4,405,844 | A | 9/1983 | Dizon et al. |
| 4,806,710 | A | 2/1989 | Kalvaitis et al. |
| 5,418,404 | A | 5/1995 | Araoka et al. |
| 5,700,985 | A | 12/1997 | Fischer et al. |
| 5,944,397 | A | 8/1999 | Zeitler |
| 5,963,420 | A | 10/1999 | Bailey et al. |

*Primary Examiner*—Michael Friedhofer
*Assistant Examiner*—Lisa N Klaus
(74) *Attorney, Agent, or Firm*—Cantor Colburn LLP

(57) ABSTRACT

A defeatable interlock mechanism for an electrical equipment enclosure requiring a circuit breaker to be tripped before opening includes a support platform having an operator handle stem operably connected to the circuit breaker, an interlock slide plate slidably positioned along the support platform and having a keyhole-shaped slot for receiving a door interlock pin therein, and a lever operably connected to the interlock slide plate and configured to defeat the interlock mechanism when the door interlock pin is engaged with the slot. The lever is pivotally supported at a fulcrum point intermediate the ends of the lever and extends through an escutcheon to an exterior surface of the enclosure. Movement of the lever causes the interlock slide plate to disengage the door interlock pin and allow the unit door to open even while the circuit breaker is in the "on" position.

12 Claims, 4 Drawing Sheets

ALTERNATE DOOR INTERLOCK DEFEATER

CROSS REFERENCE TO RELATED APPLICATIONS

This application is a continuation of U.S. application Ser. No. 09/474,512, now abandoned filed on Dec. 29, 1999 which is incorporated by reference in its entirety.

BACKGROUND OF INVENTION

The present invention relates to bypassing a door interlock mechanism on an enclosure housing electrical apparatus, and, more particularly, to bypassing a door interlock mechanism on an enclosure housing electrical apparatus while the apparatus is energized.

Enclosures housing electrical apparatus of significant voltage typically include a mechanical interlock device to prevent entry into the enclosure without first removing power to the circuit. This mechanical interlock device may, however, need to be bypassed or defeated to allow access to the components of the apparatus while the circuit is still energized. For example, it may become necessary to access the electrical apparatus while the components are still live to check thermal connections and current connections within the circuit.

One particular method of defeating a locking mechanism on an enclosure housing electrical apparatus when a circuit is energized is described in U.S. Pat. No. 5,963,420 entitled "Interlock Bypass". In that patent, when the breaker switch is in an "on" position, the door is locked closed by a slidable plate having an aperture therein located in the surface of the door adjacent the breaker switch. In the locked mode, the sliding plate is positioned such that the aperture in the door is prevented from opening over the breaker switch. The locking mechanism is defeated by inserting a key into a receptacle and turning the key to slide the plate so that the aperture is positioned over the breaker switch. When the aperture is properly positioned, the breaker switch is no longer obstructed by the plate, and the door is allowed to swing open over the breaker switch.

SUMMARY OF INVENTION

In an exemplary embodiment of the invention, a defeatable interlock mechanism for an electrical equipment enclosure requiring a circuit breaker to be tripped before opening is described. The defeatable interlock mechanism includes a support platform having an operator handle stem operably connected to the circuit breaker, an interlock slide plate positioned in a parallel planar relationship with the support platform and having a slot for receiving a door interlock pin therein, and a lever operably connected to the interlock slide plate and configured to defeat the interlock mechanism when the door interlock pin is engaged with the slot, thereby allowing the door to be opened while the circuit is energized.

The lever of the inventive mechanism is an elongated member pivotally supported at a fulcrum point intermediate the first and second ends of the lever. The first end of the lever is accessible from an exterior of the electrical equipment enclosure, and the second end of the lever is pivotally connected to the interlock slide.

An escutcheon is situated on the front of the electrical equipment enclosure door through which the first end of the lever projects. The lever is fixedly secured within the escutcheon by a retaining member that holds the lever steadfast. The retaining member is typically a lockout screw positioned transverse to the general movement of the lever. Removal of the retaining member requires the use of a tool such as a screwdriver or Allen head wrench.

Electrical systems may require an operator to access the internal components of the circuit while the system is energized. Utilizing the interlock defeating device of the present invention enables the door of an electrical equipment enclosure to be opened while the circuit is not tripped, thereby giving the operator access to the components of the circuit for maintenance procedures or system testing. Removal of the retaining member using a tool forces the operator to make a conscious and voluntary effort to gain access to the enclosure and prevents the operator from inadvertently gaining access and encountering a hazardous condition.

DETAILED DESCRIPTION

Figure 1:
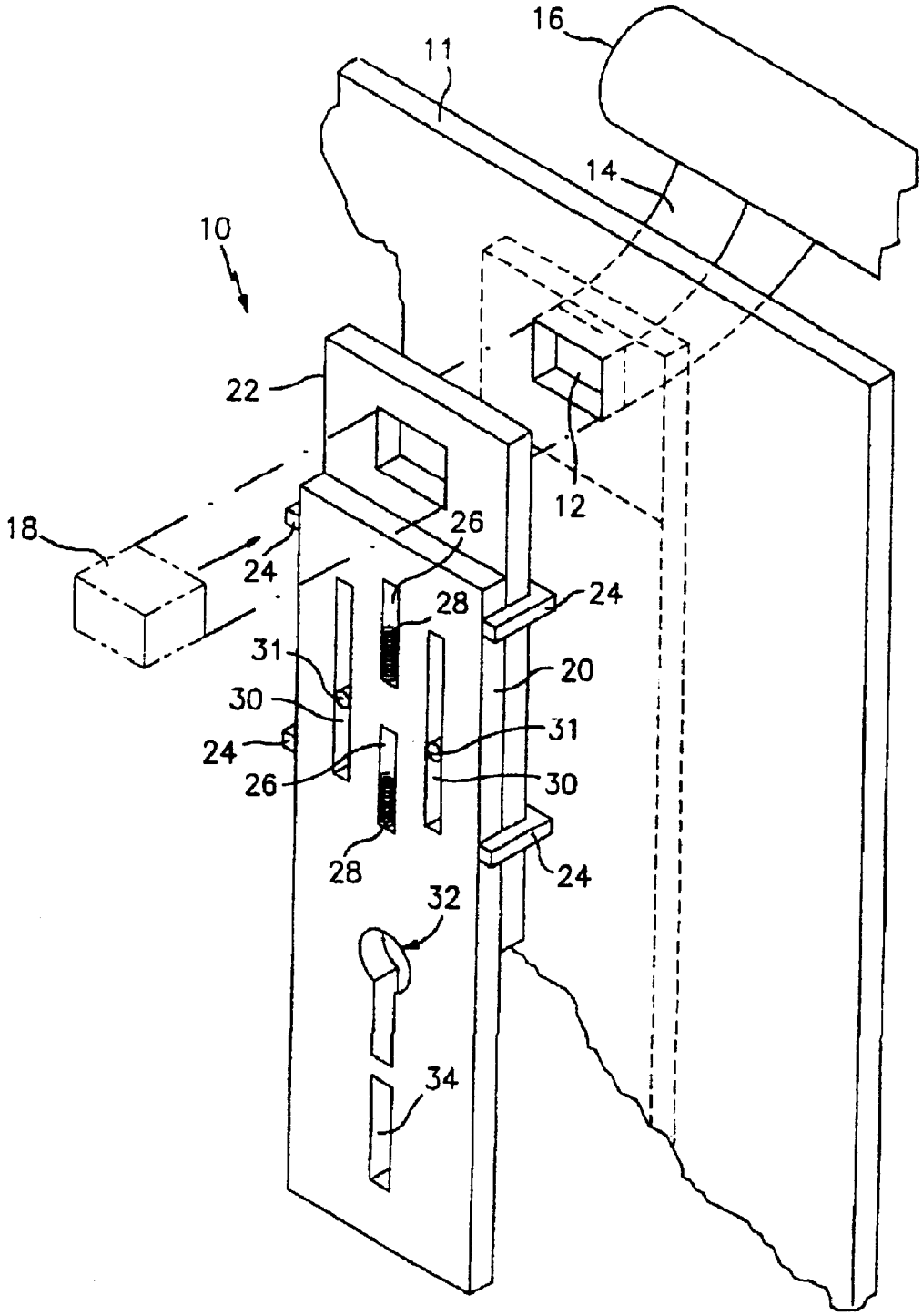
FIG. 1 is a perspective view of a door interlock mechanism as viewed from the interior of an electrical apparatus enclosure.

Referring to FIG. 1, a door interlock mechanism is shown generally at 10. Door interlock mechanism 10 is mounted inside a door 11 of a control center enclosure (not shown) and prevents access to the interior of the control center enclosure unless an associated circuit breaker in the control center enclosure is in the "tripped" or "off" position. An operator handle 16 is slidably disposed on the control center enclosure and is operably connected to the circuit breaker. A plug 18 on the circuit breaker is received in an opening 12 formed in a stem 14 of handle 16. Operator handle 16 enables the circuit to be energized or de-energized upon movement of handle 16 between "on" and "off" positions. When operating handle 16 of the circuit breaker is moved to the "on" position, the circuit is energized. As handle 16 is moved to the "on" position, door interlock mechanism 10 correspondingly slides along door 11 and traps a door interlock pin (shown below with reference to FIGS. 2, 3, and 4) depending from door 11, thereby preventing the opening of door 11 of the control center enclosure when handle 16 is in the "on" position. A door interlock defeater mechanism (shown below with reference to FIGS. 2, 3, and 4) used in conjunction with door interlock mechanism 10 enables access to be gained to the interior of the control center enclosure when the circuit breaker is in the "on" position.

Door interlock mechanism 10 comprises support platform 22 mounted inside an inner surface of door 11. Interlock slide 20 is positioned on support platform 22 by guide tabs 24, which hold interlock slide 20 in place against support platform 22. Interlock slide 20 includes a pair of spring retainer slots 26 containing compression springs 28 and a pair of extended rail slots 30 that encompass a pair of rail posts 31 projecting from support platform 22. Interlock slide 20 is arranged on support platform 22 such that compression springs 28 extend within spring retaining slots 26 and attach to support platform 22 on one end at pins 23 extending through spring retaining slots 26 from support platform 22. Compression springs 28 also attach to interlock slide 20 on a second end thereof at pins 25 positioned across spring retaining slots 26 on interlock slide 20. The connection between compression springs 28, interlock slide 20, and support platform 22 biases interlock slide 20 against plug 18 and enables interlock slide 20 to slidably engage support platform 22.

Upon closing the door, an interlock slot 32 receives the door interlock pin (shown below with reference to FIGS. 2, 3, and 4) protruding from an inner side of door 11 and a rectangular interlock defeater slot 34 receives an interlock defeater lever (shown below with reference to FIGS. 2 and 3) pivotally mounted on door 11. As stated above, the door interlock defeating mechanism allows door 11 to be opened while the circuit breaker is still in the "on" position.

Figure 2:
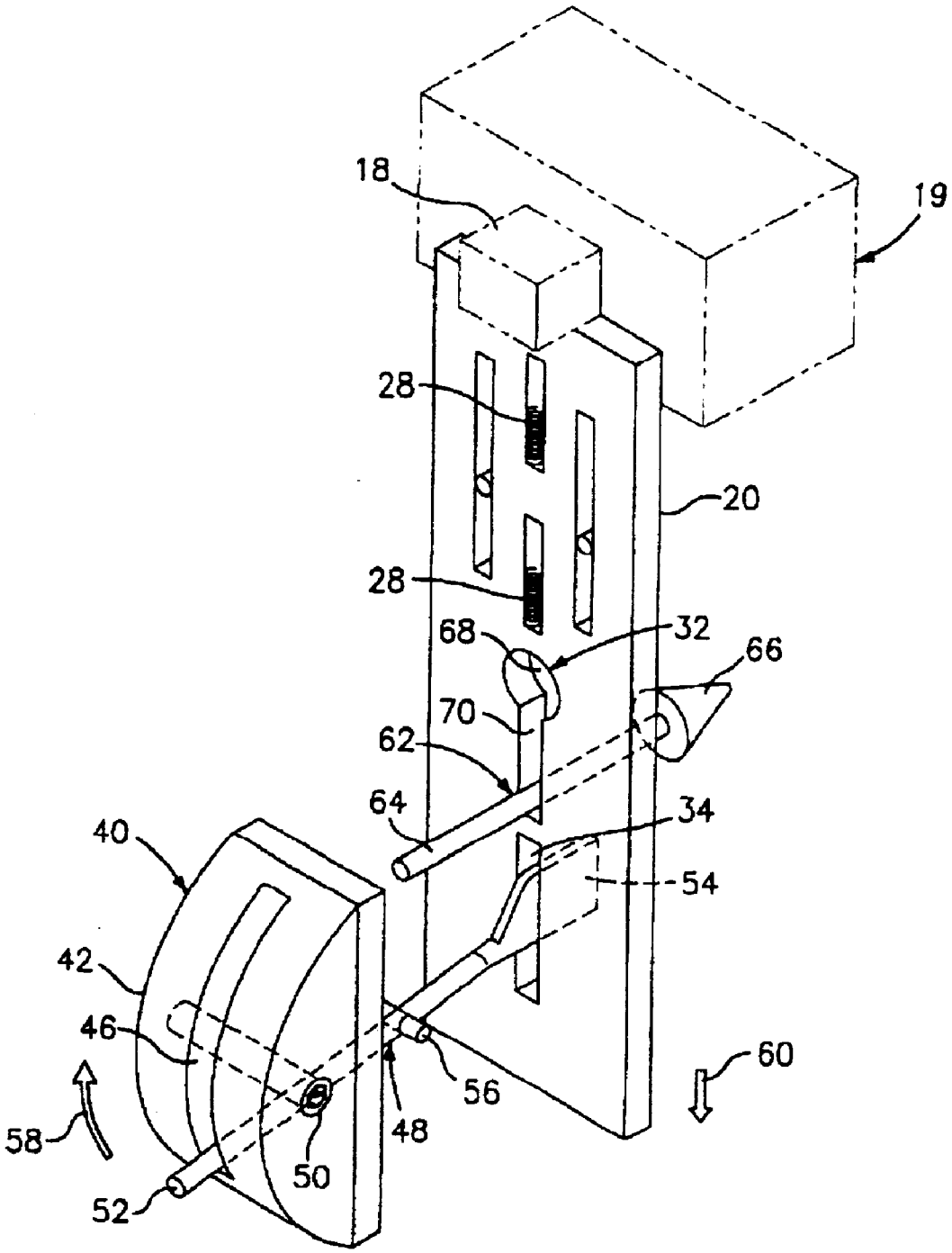
FIG. 2 is a perspective view of the door interlock mechanism and a door interlock defeating mechanism, of the present invention, from the exterior of an electrical apparatus enclosure.
Figure 3:
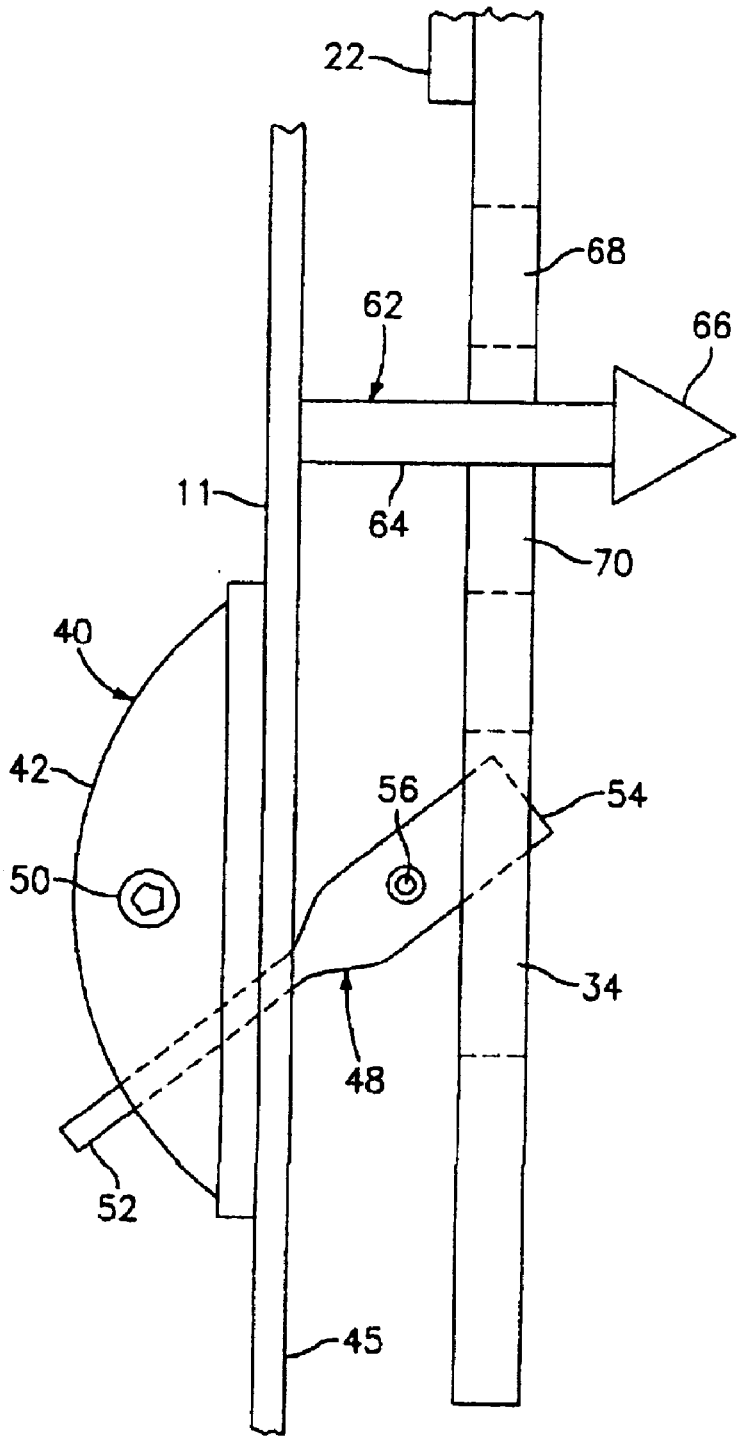
FIG. 3 is a side elevated view of the door interlock and the door interlock defeating mechanism, of the present invention, of FIG. 2.

Referring now to FIGS. 2 and 3, a door interlock defeating mechanism is shown generally at 40. Door interlock defeating mechanism 40 is operably connected to the door interlock mechanism and comprises an escutcheon 42 rigidly secured to door 11. For clarity, support platform 22 is not shown in FIGS. 2 and 4. Escutcheon 42 has disposed lengthwise within it a lever slot 46, which, when positioned over an opening (not shown) in door 11, receives a lever shown generally at 48 that is used to defeat door interlock mechanism 10. A lockout screw 50 threadedly secured transversely through escutcheon 42 prevents the movement of lever 48, thereby preventing the defeating of door interlock mechanism 10 and the inadvertent opening of door 11 while the circuit is energized. Lockout screw 50 is secured in such a manner such that the removal thereof is achieved by a deliberate and volitional act on the part of a person using a tool (not shown) such as a screwdriver or an Allen head wrench.

Lever 48 is pivotally mounted to either an interior surface 45 of door 44 or to support platform 22. Lever 48 has a first end 52 and a second end 54 and is pivotally mounted using a pivot pin 56 configured to be transverse to a longitudinal axis of lever 48. Pivot pin 56 is mounted as a fulcrum intermediate first end 52 and second end 54 of lever 48. Lever 48 is positioned such that first end 52 of lever 48 is received through the opening in door 11 and extends through lever slot 46 in escutcheon 42. Second end 54 of lever extends into defeater slot 34 in interlock slide 20 when door 11 is closed such that when first end 52 of lever 48 is moved in the direction of a first arrow 58, interlock slide 20 is moved in the direction of a second arrow 60 against the bias of springs 28.

The door interlock pin is shown generally at 62. Door interlock pin 62 comprises a post 64 having one end fixedly attached to interior surface 45 of door 11 and projecting substantially normally away from the general plane of door 11. Post 64 has secured to its opposite end a retaining member 66, which is shown as being of a general conical shape. When door 11 is closed, the circuit is powered up, and the door interlock mechanism is not defeated, door interlock pin 62 projects through interlock slot 32, thus locking door 11 closed. In alternate embodiments, retaining member 66 may be of any shape capable of being received in interlock slot 32 and securing retaining member 66 therein.

In FIG. 2, interlock slot 32 is shown in detail being engaged by door interlock pin 62. Interlock slot 32 comprises a circular aperture 68 and an elongated aperture 70 to define a keyhole-shaped opening. The dimensions of retaining member 66 are such that retaining member 66 can be received in and extend completely through circular aperture 68, and the width of post 64 is such that post 64 slidably engages elongated aperture 70 when positioned transversely through elongated aperture 70. The width of retaining member 66 at the point at which retaining member 66 is connected to post 64 exceeds the width of elongated aperture 70 and prevents retaining member 66 from being pulled back through elongated aperture 70 when door interlock pin 62 engages interlock slot 32 and a force normal to the plane of interlock slot 32 is applied to door interlock pin 62. The diameters of retaining member 66 and post 64 and the length and width of elongated aperture 70 are also dimensioned to compensate for tolerance accumulation between the components of interlock slide 20 and support platform 22, as well as on interior surface 45 of enclosure door 11.

Figure 4:
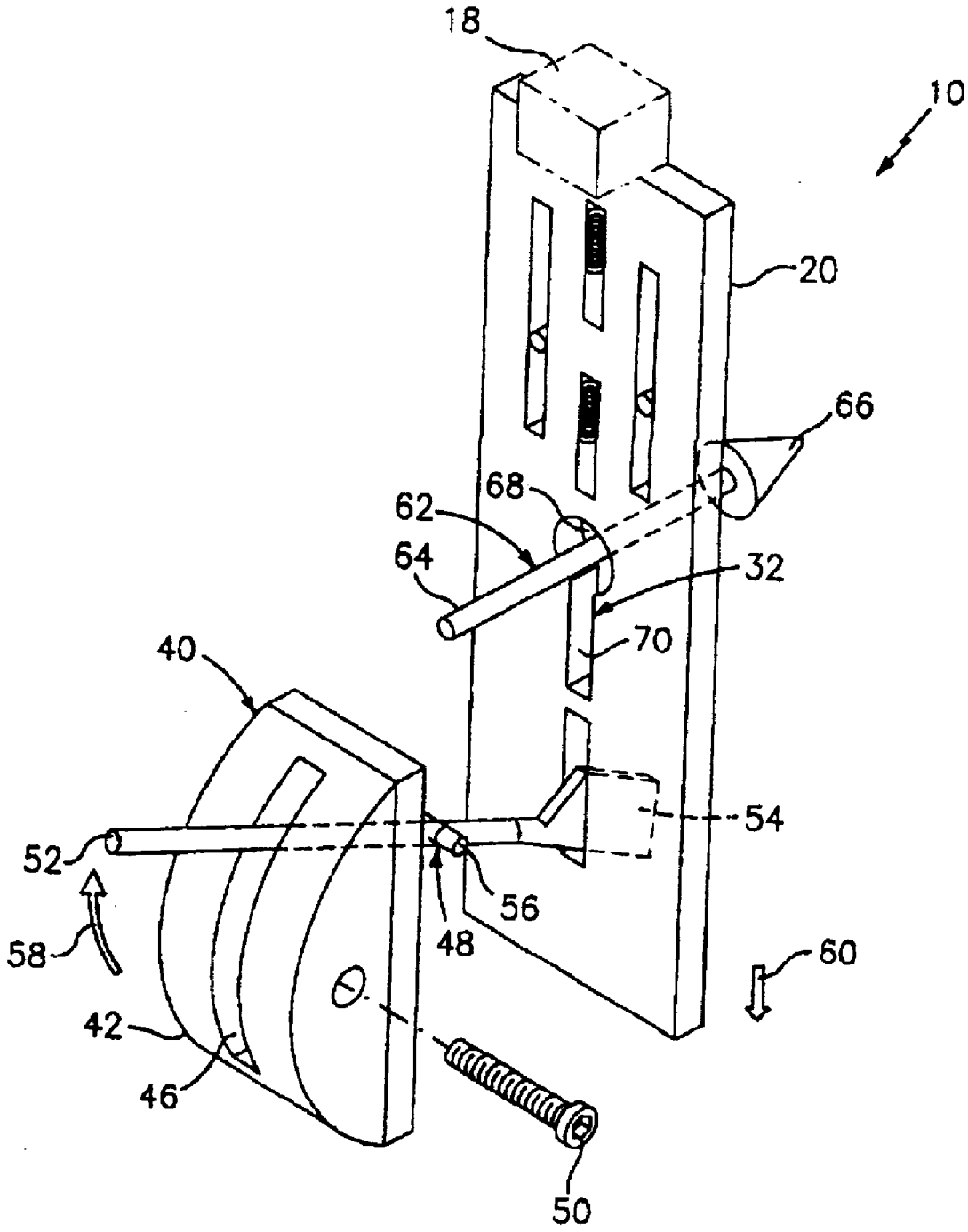
FIG. 4 is a perspective view of the door interlock and the door interlock defeating mechanism, of the present invention, defeating the door interlock.

Referring now to FIG. 4, door interlock defeating mechanism 40 is shown defeating door interlock mechanism 10. When handle 16 (as is shown in FIG. 1) is moved to the "on" position, the circuit breaker is "on," and the circuit is energized. The sliding of the handle to the "on" position slides support platform 22 upwards and biases interlock slide 20 such that door interlock pin 62 is received in elongated aperture 70, thereby preventing the opening of door 11. The door interlock can then be defeated by deliberately removing lockout screw 50 with the required tool and moving lever 48 in the direction of first arrow 58. Moving lever 48 in the direction of first arrow 58 causes lever 48 to pivot about pivot pin 56 thereby biasing interlock slide 20 in the direction of second arrow 60. As interlock slide 20 moves, post 64 disengages elongated aperture 70 and is axially received in circular aperture 68. Retaining member 66 on door interlock pin 62 can then pass through circular aperture 68 thereby enabling door 11 to be opened even though circuit breaker 19 is still in the "on" position.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A defeatable interlock mechanism for an electrical equipment enclosure including a door and a handle extending from the door, said handle being movable between "on" and "off" positions, said defeatable interlock mechanism comprising:

a support platform slidably mounted to the door of the electrical equipment enclosure, said support platform being operably coupled to the handle;

an interlock slide mounted in sliding contact with said support platform, said interlock slide including a retaining member slot formed within said interlock slide, said retaining member slot being dimensioned and positioned to capture a door interlock pin depending from an inner surface of the door when the handle is positioned in the "on" position; and a lever operably engagable with said interlock slide, wherein said lever positions said interlock slide to release said door interlock pin from said retaining member slot for allowing the door to be opened when the handle is in the "on" position.

2. The defeatable interlock mechanism of claim 1 wherein said lever comprises an elongated member having a first end and a second end, said first end being accessible from an exterior of said electrical equipment enclosure, and said second end engagable with said interlock slide.

3. The defeatable interlock mechanism of claim 2 wherein said lever is pivotally supported at a fulcrum point located intermediate said first end and said second end.

4. The defeatable interlock mechanism of claim 2 wherein said first end of said lever projects through an escutcheon positioned on said exterior of said electrical equipment enclosure.

5. The defeatable interlock mechanism of claim 4 wherein said escutcheon contains a retaining member capable of preventing movement of said lever within said escutcheon.

6. The defeatable interlock mechanism of claim 5 wherein said retaining member is a lockout screw requiring removal with a tool prior to movement of said lever within said escutcheon.

7. An electrical equipment enclosure, comprising:

a door;

a handle extending from said door, said handle being movable between "on" and "off" positions; and a defeatable interlock mechanism, said defeatable interlock mechanism comprising, a support platform slidably mounted to said door, said support platform being operably coupled to said handle, an interlock slide mounted in sliding contact with said support platform, said interlock slide including a retaining member slot formed within said interlock slide, said retaining member slot being dimensioned and positioned to capture a door interlock pin depending from an inner surface of said door when said handle is positioned in the "on" position, and a lever operably engagable with said interlock slide, wherein said lever positions said interlock slide to release said door interlock pin from said retaining member slot for allowing the door to be opened when the handle is in the "on" position.

8. The electrical equipment enclosure of claim 7 wherein said lever comprises an elongated member having a first end and a second end, said first end being accessible from an exterior of the electrical equipment enclosure, and said second end is engagable with said interlock slide.

9. The electrical equipment enclosure of claim 8 wherein said lever is pivotally supported at a fulcrum point located intermediate said first end and said second end.

10. The electrical equipment enclosure of claim 8 wherein said first end of said lever projects through an escutcheon positioned on an exterior surface of the door of the electrical equipment enclosure.

11. The electrical equipment enclosure of claim 10 wherein said escutcheon contains a retaining member capable of preventing movement of said lever within said escutcheon.

12. The electrical equipment enclosure of claim 11 wherein said retaining member is a lockout screw requiring removal with a tool prior to movement of the lever with said escutcheon.

* * * * *